US010624503B2

(12) United States Patent
Tramontina et al.

(10) Patent No.: US 10,624,503 B2
(45) Date of Patent: Apr. 21, 2020

(54) ELECTRONIC LIQUID DISPENSER

(71) Applicant: Kimberly-Clark Worldwide, Inc., Neenah, WI (US)

(72) Inventors: Paul F. Tramontina, Harleysville, PA (US); Charles A. Osborne, Jr., Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 16/344,259

(22) PCT Filed: Oct. 31, 2016

(86) PCT No.: PCT/US2016/059755

§ 371 (c)(1),
(2) Date: Apr. 23, 2019

(87) PCT Pub. No.: WO2018/080545

PCT Pub. Date: May 3, 2018

(65) Prior Publication Data

US 2019/0254488 A1 Aug. 22, 2019

(51) Int. Cl.
*A47K 5/12* (2006.01)
*A47K 5/16* (2006.01)

(52) U.S. Cl.
CPC ..... *A47K 5/1217* (2013.01); *A47K 5/12* (2013.01); *A47K 5/1205* (2013.01); *A47K 5/16* (2013.01); *A47K 2005/1218* (2013.01)

(58) Field of Classification Search
CPC ..... A47K 5/12; A47K 5/1205; A47K 5/16; A47K 2005/1218; A47K 5/1217; B05B 12/08; B67D 7/06; B67D 7/32; B67D 1/00; B67D 5/38; B65D 83/00; B05C 11/10

See application file for complete search history.

(56) References Cited

U.S. PATENT DOCUMENTS 4,651,632 A * 3/1987 Motsch ..... A47J 31/057 99/283
5,265,773 A * 11/1993 Harada ..... B01F 7/00208 222/241
5,344,047 A * 9/1994 Chen ..... A47K 5/1217 222/333
5,492,247 A 2/1996 Shu et al.
5,836,482 A * 11/1998 Ophardt ..... A47K 5/1202 222/325
5,966,753 A * 10/1999 Gauthier ..... A47K 5/12 4/623
6,899,149 B1 * 5/2005 Hartsell, Jr. ..... B67D 7/0486 141/192
7,070,066 B2 7/2006 Strong et al.
7,668,690 B2 2/2010 Schneider et al.
8,453,877 B2 6/2013 Ionidis
9,211,041 B2 12/2015 Curtis et al.
9,572,944 B2 * 2/2017 Van Der Sluis ..... A61M 11/005
10,040,660 B1 * 8/2018 Malesky ..... H02P 29/00
10,420,444 B2 * 9/2019 Borke ..... A47K 10/3618
(Continued)

*Primary Examiner* — Patrick M. Buechner
(74) *Attorney, Agent, or Firm* — Kimberly-Clark Worldwide, Inc

(57) ABSTRACT

Methods, systems and apparatus for operating a liquid dispenser based on the number of revolutions of the motor causing the dispensing operation and/or based on the linear distance traveled of the piston driving the dispensing pump.

17 Claims, 4 Drawing Sheets

(56) References Cited

U.S. PATENT DOCUMENTS

| | | | | |
|---|---|---|---|---|
| 2005/0133100 | A1* | 6/2005 | Bolderheij | E03C 1/04 137/801 |
| 2005/0218161 | A1 | 10/2005 | Muderlak et al. | |
| 2006/0096530 | A1* | 5/2006 | Klein | B05C 11/10 118/665 |
| 2011/0017778 | A1 | 1/2011 | Kadiks et al. | |
| 2011/0108578 | A1 | 5/2011 | Wegelin et al. | |
| 2012/0006848 | A1 | 1/2012 | Reynolds | |
| 2012/0150344 | A1* | 6/2012 | Jennings | B67D 7/04 700/244 |
| 2013/0292410 | A1 | 11/2013 | Pelkey et al. | |
| 2014/0151394 | A1* | 6/2014 | Curtis | A47K 5/1217 222/1 |
| 2014/0197196 | A1 | 7/2014 | Tederous et al. | |
| 2014/0205473 | A1 | 7/2014 | Ciavarella et al. | |
| 2015/0265107 | A1 | 9/2015 | Buckalter et al. | |
| 2015/0280441 | A1* | 10/2015 | Zosimadis | A47K 5/12 307/154 |
| 2015/0313420 | A1 | 11/2015 | Tramontina et al. | |
| 2016/0374519 | A1* | 12/2016 | Murphy | A47K 5/1217 222/23 |

* cited by examiner

ELECTRONIC LIQUID DISPENSER

FIELD OF THE INVENTION

The present disclosure relates generally to the field of electronic liquid dispensers, such as liquid soap and sanitizing dispensers.

BACKGROUND

Electronic dispensers for dispensing metered doses of a liquid are well known in the art. Such dispensers are commonly used to dispense soap, lotions, disinfectants, and the like in facilities, such as, for example, restaurants, hospitals, office buildings, public and private washrooms, and break rooms. These dispensers are typically "hands-free" systems where a sensor, e.g., infrared or capacitive sensor, detects the presence of person's hands adjacent the dispenser and, in response, a controller causes a motor to automatically start and engage a pump mechanism to dispense a metered dose of the liquid onto the person's hands.

Such dispensers, through hardware or software configurations or settings, are often matched to the amount of the metered dose. Thus a hardware or software re-configuration is typically required to change the size of the metered dose (e.g., as may occur when changing to a new refill container with a different metered dose amount), which limits the ease and practicality of changing the metered dose amount/refill container to suit the desired application and environment.

SUMMARY

In general, the subject matter of this specification relates to electronic liquid dispensers. One aspect of the subject matter described in this specification can be implemented in methods that include receiving a dispense request for a liquid; actuating a motor to move a piston from a home position to a dispense position during an initial dispense cycle to dispense the liquid; monitoring a current demand of the motor during the initial dispense cycle; determining a spike in the current demand; determining a number of revolutions of the motor between actuating the motor and determining the spike; and reversing the motor the number of revolutions to move the piston towards the home position. Other embodiments of this aspect include corresponding systems.

Another aspect of the subject matter described in this specification can be implemented in a system that includes an electronic liquid dispenser comprising a dispensing head comprising a dispensing sensor configured to issue a dispensing trigger in response to a user stimulus proximate the dispensing head; a motor comprising a piston, wherein the motor is configured to move the piston from a home position to a dispensing position in response to the dispensing trigger; a liquid container comprising liquid and a pump operatively connected to the piston and configured to drive the liquid from the liquid container in response to the piston moving from the home position to the dispensing position; and a processing device coupled to the motor and configured to control an operation of the motor and determine a number of motor revolutions required to move the piston from the home position to the dispensing position based on a current spike to the motor indicating that the piston has reached the dispensing position. Other embodiments of this aspect include corresponding methods.

In some implementations, the systems and apparatuses described herein have one or a combination of the following features. The number of revolutions can be decreased by a specific value to a reduced revolution count; and after the initial dispense cycle, the motor is driven the reduced revolution count to move the piston from the home position towards the dispense position (e.g., without bottoming out and causing wear and tear on the motor and dispenser generally). The features can include detecting a refill has been inserted into the dispenser and, in response to the detecting, monitoring the current demand; determining the spike in the current demand; determining the number of revolutions of the motor between actuating the motor and determining the spike.

In some aspects the features can include, in response to the detecting, repeating, for each of a plurality of dispense cycles, monitoring the current demand, determining a spike in the current demand, and determining a number of revolutions of the motor between actuating the motor and determining the spike; and determining an average number of revolutions of the motor based on the determined numbers of revolutions across the plurality of dispense cycles. Monitoring the current demand can include detecting an in rush current, wherein the in rush current indicates the motor has been actuated including, for example, where the in rush current is greater than the spike. The spike indicates the piston is at an end of its stroke at the dispense position.

In some aspects, moving the piston from the home position to the dispense position takes longer than moving the piston from the dispense position back to the home position. The number of revolutions of the motor can be determined by using a Hall Effect sensor to count the number of revolutions. The piston can move from the home position to the dispense position and back through a rack and pinion system coupled to the motor.

The feature of monitoring the current can include comparing the current demand during the initial dispense cycle to one or more known current dispensing profiles to determine if the current demand matches at least one of the one or more known current dispensing profiles, and, in response to determining the current demand does not match at least one of the one or more known current dispensing profiles, preventing further dispensing, and/or communicating an alert indicating that an unauthorized refill has been detected and/or causing the dispenser to reduce an amount of liquid normally dispensed and/or causing the motor to move the piston at a reduced speed.

Particular embodiments of the subject matter described in this specification can be implemented so as to realize one or more of the following advantages. For example, the dispenser can auto-calibrate to and use various liquid containers with different size metered dose amounts (or pump sizes) without the need for any user reconfiguration of the dispenser hardware or configuration or software settings.

Liquid containers for various products, e.g., soap, sanitizers, etc., and from different manufacturers can require different levels of effort to dispense, e.g., different power levels or varying motor on/offs times to accommodate different containers. These differences can result from the various mechanical components of the containers such as spring resistance in the liquid container pump, the configuration and size of the chamber holding the metered dose and/or the type of liquid in the chamber, which may have varying viscosities and thus different flow characteristics. In terms of motor current draw, over the course of the dispense process these differences result in particular signatures, e.g., current and/or voltage profiles, that can be used to identify and/or determine the type of container installed and/or whether the container is an authorized or unauthorized container. If an unauthorized container is installed and detected, for example, an alert can be provided or the dispenser can prevent or reduce further dispensing.

In some scenarios a liquid container may not be fully or correctly installed or attached to the dispenser, which can result in suboptimal dispensing or no dispensing. Based on the signatures described above, it can be determined that the container is not correctly installed and an alert sent to correct the condition.

Based on knowing the number of motor revolutions required to move the piston its full stroke (to cause a dispense) from its home position to the dispensing position, at which point the piston bottoms out, the dispenser can be operated in a way that prevents the piston from bottoming out by moving the piston less than its full stroke by limiting the number of motor revolutions moving the piston towards the dispensing position. Avoiding bottoming out the piston, in turn, reduces unwanted wear and tear on the motor and other components of the dispenser and increases dispenser life.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference symbols in the various drawings indicate like elements.

DETAILED DESCRIPTION

Figure 1A:
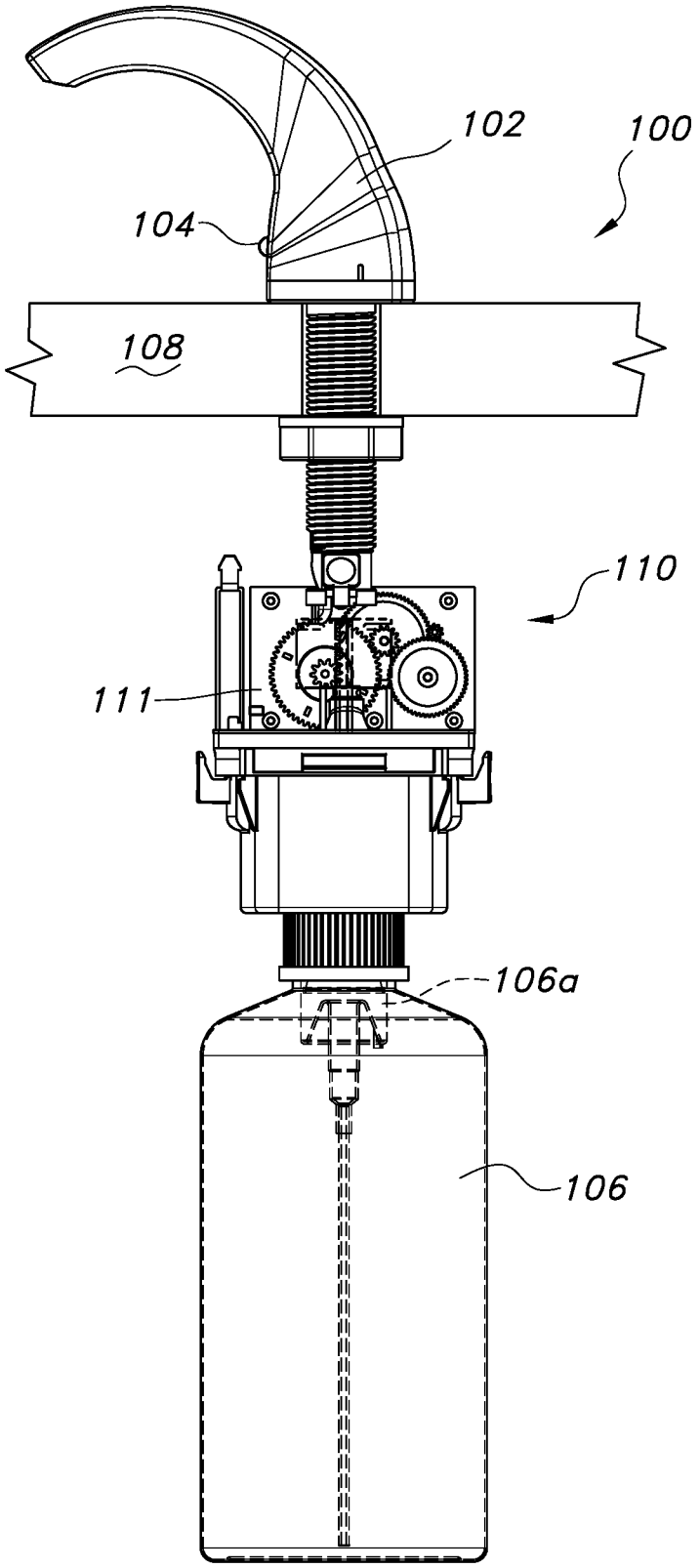
FIG. 1A is a partial cutaway representation of an example electronic liquid dispenser.

As discussed, the subject matter herein relates to electronic liquid dispensers. The dispenser can dispense doses of a viscous liquid or foam, such as soap, disinfectant, moisturizer, sanitizer, and the like, from a liquid container or other reservoir (e.g., plastic bottle or a bag-type container). To dispense the liquid, the dispenser includes a motor that drives a dispensing mechanism that engages the liquid container to force a metered amount of liquid out of a chamber associated with the container. For example, the motor drives a piston into a pump to cause liquid to be dispensed from the chamber. Thus, for example, to dispense the full dose in the chamber the piston must drive the pump the full length of the chamber or the pump's stroke, depending on the dispenser's configuration. If, for example, the container is replaced with another one with a shorter chamber length then driving the piston the full length of the previous chamber will result in a malfunction, as the replacement container has a shorter chamber and the piston will try to drive through the bottom of the shorter chamber. To address this issue, the dispenser described herein has auto-calibration and piston stroke length determination capabilities, as described below.

The dispenser monitors the current draw from the motor to determine when the piston has been driven its full stroke for that container (e.g., to push the pump the full length of the chamber), which is indicated by a current spike in the motor current draw. More specifically, in response to a dispense request, the dispenser counts the number of motor revolutions to move the piston from its starting position to the position at which there is a current spike, which occurs when the pump, driven by the piston, bottoms out at the base of the chamber—corresponding to a full dispense. In response to determining the current spike has occurred, the dispenser then reverses the motor that same number of revolutions to return the piston to its starting position in preparation for another dispense. In this way, the dispenser auto-calibrates and automatically adjusts to various containers, including with different metered dose amounts and chamber lengths, without any user input or reconfiguration required.

After such calibration, the dispenser causes the motor to turn the counted number of revolutions (or a reduced number of revolutions as described below) to drive the piston from its starting position to the position that dispensers the metered dose and reverse the same number of revolutions to return the piston to the staring position. When a new liquid container is determined to have been installed, the auto-calibration process initiates again to determine the number of revolutions needed for the new container to deliver a full dose, which may be the same or different depending on whether a different container has been installed. The dispenser is described in more detail below with reference to FIG. 1A, which is partial cutaway representation of an example electronic liquid dispenser 100.

The dispenser 100 includes a dispensing head 102 and a liquid container 106. The liquid container 106 holds the liquid to be dispensed by the dispenser 100. The dispensing head 102 includes a channel that accepts liquid from the container 106 to direct the liquid out of the dispenser 100, e.g., onto the hands of a user, through use of a pump/chamber 106*a* in, for example, the container 106. In some implementations, such as counter-mount dispensers, as shown in FIG. 1A, the dispensing head 102 resembles a faucet and the container 106 is a plastic bottle or bag or pouch that is mounted underneath the counter 108.

The pump pump/chamber 106*a* (e.g., a foam soap pump) utilizes a spring (not shown) to create a vacuum inside the pump pump/chamber 106*a* which allows liquid to enter from the bottom of the pump 106*a* and air to enter from the top. In some implementations, a check valve in the bottom of the pump 106*a* is used to allow the liquid to travel in one direction—into the pump/chamber 106*a*, and a diaphragm placed over ports in the top of the pump/chamber 106*a* is used to allow the air to travel in one direction—into the pump/chamber 106*a*. The upward stroke produced by the internal force of the spring sucks the liquid and air into the pump/chamber 106*a*. The downward stroke of the pump pump/chamber 106*a* produced by an external mechanism or user mixes and pressurizes the liquid and the air simultaneously. The mixture is forced out the top of the pump/chamber 106*a* through a mesh producing foam. For liquid soaps the mesh and air mixing is not needed.

The dispensing head 102 includes a dispensing sensor 104 to issue a dispensing trigger in response to a user stimulus proximate the dispensing head 102. The sensor 104 may be, for example, a heat sensor, motion sensor, proximity sensor (e.g., an infrared sensor) or the like to detect the presence of a user in relatively close proximity to the dispenser head 102. In response to detecting a user (e.g., user's hand(s) near the dispensing head 102), the sensor 104 generates a trigger signal. In some implementations, the trigger signal is detected by the motor module 110 to initiate a dispense, as described below.

Upon actuation, e.g., in response to detecting the trigger signal or another instruction or signal, the motor module 110 operates to drive liquid from the container 106 out through the dispensing head 102. The motor module 110 can include, for example, a DC motor. Power for the motor module 110 (and associated circuitry in the motor module 110) may be supplied by one or more replaceable batteries (not shown) or may be a direct hard-wire supply, for example DC current converted from a building's power (AC) system.

Figure 1C:
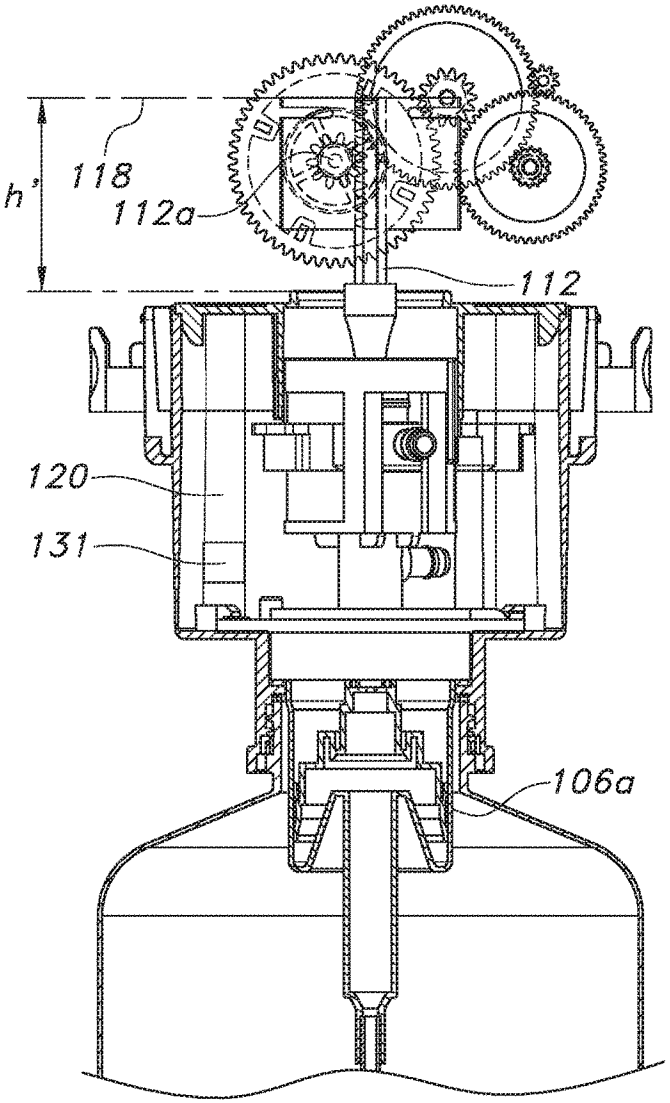
FIG. 1C is a partial cutaway representation of an example piston at the dispense position.
Figure 1B:
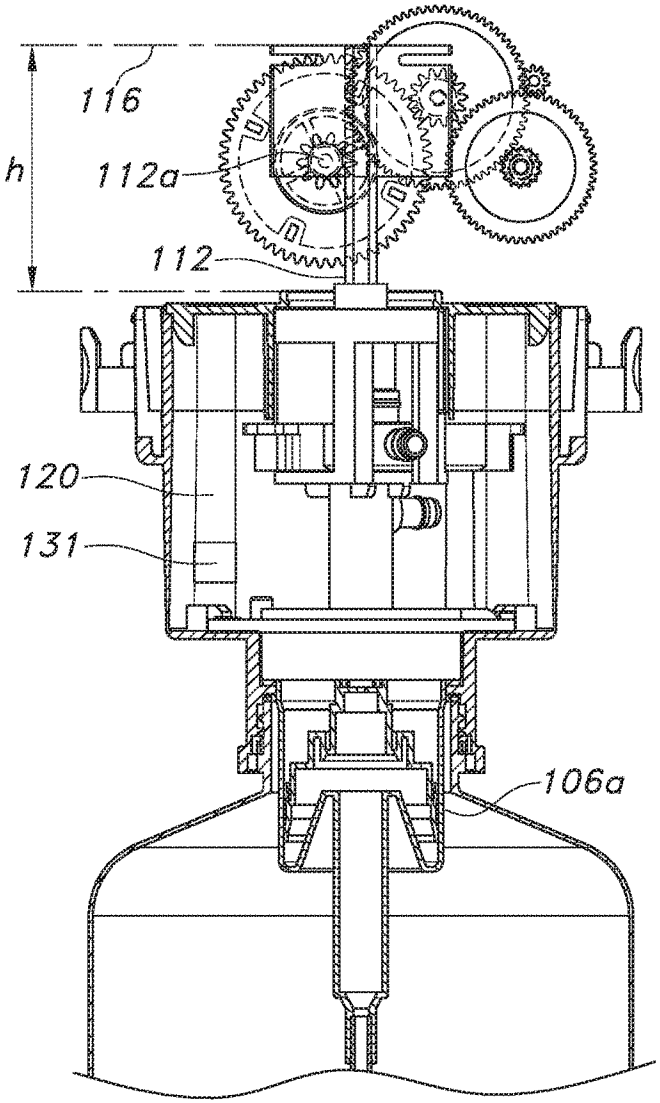
FIG. 1B is a partial cutaway representation of an example piston at the home position.

The motor module 110 includes a motor 111 and a piston 112, as shown in FIG. 1B, which is a partial cutaway representation of the motor module 110 at the home position 116 (at a height "h"). The motor 111 moves the piston 112 from a home position 116 to a dispensing position 118 in response to the dispensing trigger signal. The home position 116 is the resting position of the piston 112, along a linear path, before a dispense is initiated and after the dispense is fully completed. The piston 112 can be biased to the home position 116 by a spring or other resilient device to encourage the piston 112 to return to (or stay at) the home position 116. The dispense position 118 is the position along the linear path at which the piston 112 bottoms out the pump/chamber 106*a*, e.g., at the end of the piston's stroke for that container 106. The piston 112 is shown at the dispense position 118 in FIG. 1C, which is a partial cutaway representation of the motor module 110 at the dispense position 118 (at a height "h" that is less than height "h" of 116).

In some implementations, the motor module 110 engages to the piston 112 through a set of gears, with the piston 112 including a geared linear rod. For example, the motor module 110 and piston 112 function as a rack (e.g., piston 112) and pinion (a gear 110*a* on the output shaft of the motor 111 in the module 110) system to drive the piston 112 along a linear path to cause liquid to be dispensed from the container 106. For example, the piston 112 moves from the home position 116 to the dispense position 118 to cause the pump 106*a* to push out a metered amount of liquid in its chamber through the dispensing head 102. Upon the return of the piston 112 from the dispense position 118 to the home position 116 after the liquid has been dispensed, the pump/chamber 106*a* draws a new metered amount of liquid in preparation for the next dispense cycle. The operation of the motor module 110, and the dispenser 100 in general, is controlled by the processing device 120.

The processing device 120 is a combination of software (e.g., firmware) and hardware (e.g., microcontrollers, memory) that controls the operation of the dispenser 100. The processing device 120 is coupled to the motor module 110 and determines a number of motor revolutions of the motor required to move the piston 112 from the home position 116 to the dispensing position 118. The processing device 120 can then cause the piston 112 to return to the home position 116 by reversing the motor the same number of revolutions. Thus, in some implementations, the position and movement of the piston 112 during a dispense cycle is controlled in terms of motor revolutions.

To this end, in some implementations, the processing device 120 includes or has access to a current and/or voltage sensor 131 to monitor the current draw of the motor 111, in the motor module 110, over time. The processing device 120 monitors the current draw during a dispense cycle, e.g., the piston 112 moving from the home position 116 to the dispense position 118 and back to the home position 116, which produces a current profile over time. The processing device 120 monitors this current profile to detect certain events indicative of piston 112 and/or pump 106*a* position and/or movement.

Figure 2A:
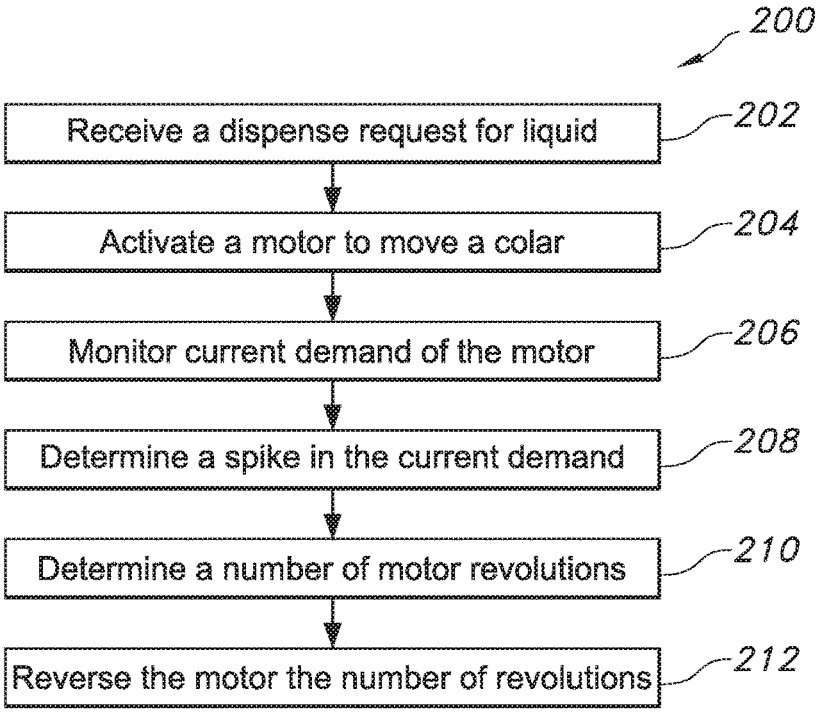
FIG. 2A is an example method for controlling a liquid dispenser.

Based on the current draw of the motor module 110 during the dispense cycle, the processing device 120 determines how many motor revolutions are required to drive the piston 112 from the home position 116 to the dispensing position 118. The processing device 120 can then reverse the motor 111 the same number of revolutions to return the piston 112 to its home position 116. The processing device 120 and/or motor module 110 can include a sensor to count motor revolutions. For example, in some implementations, the motor shaft, e.g., which is connected to and rotates the pinion 110*a*, has a magnet that rotates as the motor shaft turns. A Hall Effect sensor is mounted in close proximity so that the magnet passes the sensor during each rotation/revolution. The output from the Hall Effect sensor can be provided to or sensed by the processing device 120 to count the number of motor revolutions, which, for example, can be a 1:1 ratio for each full rotation of the pinion 110*a*. From this revolution count, the processing device 120 can control the dispensing process including accommodating various pumps, of different sizes, without user intervention, as described in more detail below with reference to FIG. 2A, which is an example method 200 for controlling a liquid dispenser 100.

A dispense request for a liquid is received (202). For example, the dispensing sensor 104 detects the presence of a user in proximity to the dispensing head 102, corresponding to a dispense request, and sends a trigger signal to the processing device 120 or the trigger signal is otherwise detected by the processing device 120.

A motor is actuated to move a piston from a home position to a dispense position during an initial dispense cycle to dispense the liquid (204). For example, the processing device 120, e.g., in response to detecting the trigger signal from the sensor 104, actuates the motor 111 in the motor module 110 to move the piston 112 from the home position 116 to the dispense position 118, which causes the liquid in the pump/chamber 106*a* to be pushed up and out through the dispensing head 102. As described above, in some implementations, the motor 111 drives the piston 112 through a rack and pinion type arrangement where the motor 111 rotates a gear 110*a* that engages a linear rod (which can be part of the piston 112) that moves up and down to drive the piston 112, which, in turn, actuates the pump 106*a* to cause liquid to be dispensed.

In some implementations, in response to detecting the trigger signal, the processing device 120 starts a counter, e.g., software/firmware based, that counts the number of motor revolutions, e.g., as described above based on a magnet and a Hall Effect sensor, needed to move the piston 112 from the home position 116 to the dispensing position 118. This value, i.e., number of motor revolutions, can be stored in the memory of the processing device 120. As described below, the dispensing position 118 can be determined based on the motor current demand/draw. In some implementations, alternatively or additionally to counting/determining motor revolutions, the linear distance the piston 112 moves from the home position 116 to the dispensing position 118 is measured and recorded by the processing device 120, e.g., through optical, capacitive or resistive sensors placed on or proximate the piston 112, which can be used to determine how far the piston 112 moved between the home 116 and dispensing 118 positions. The processing device 120, in turn, can then return the piston 112 to its home position 116 by moving the piston 112 that same length/distance in reverse.

In some implementations, the processing device 120 can measure and record the time it takes for the piston 112 to move from the home position 116 to the dispensing position 118 and then reverse the motor 111 that same amount of time to attempt to return the piston 112 back to the home position 116. However, given that the spring biases the piston 112 towards the home position 116, the spring aids the motor 111 in returning the piston 112 home so the time is reduced as compared to the trip time from the home position 116 to dispensing position 118, as shown in Table 1 below. Further, this trip time may fluctuate over the course of the dispenser's life as the spring force will change with use and age. To address this situation, the processing device 120 can use motor revolutions or linear distance traveled by the piston 112 as discussed above.

In some implementations, the initial dispense cycle is the dispense cycle, e.g., the processing of detecting a request for liquid and dispensing the liquid, immediately following a new or refill container 106 being inserted/attached for use with the dispenser 100. In some implementations, the initial dispense cycle is the first dispense cycle in the auto-calibration process which may or may not coincide with a new or refill container 106 being inserted, e.g., the auto-calibration process could be initiated by a system administrator or after a specified time or number of dispenses.

Figure 2B:
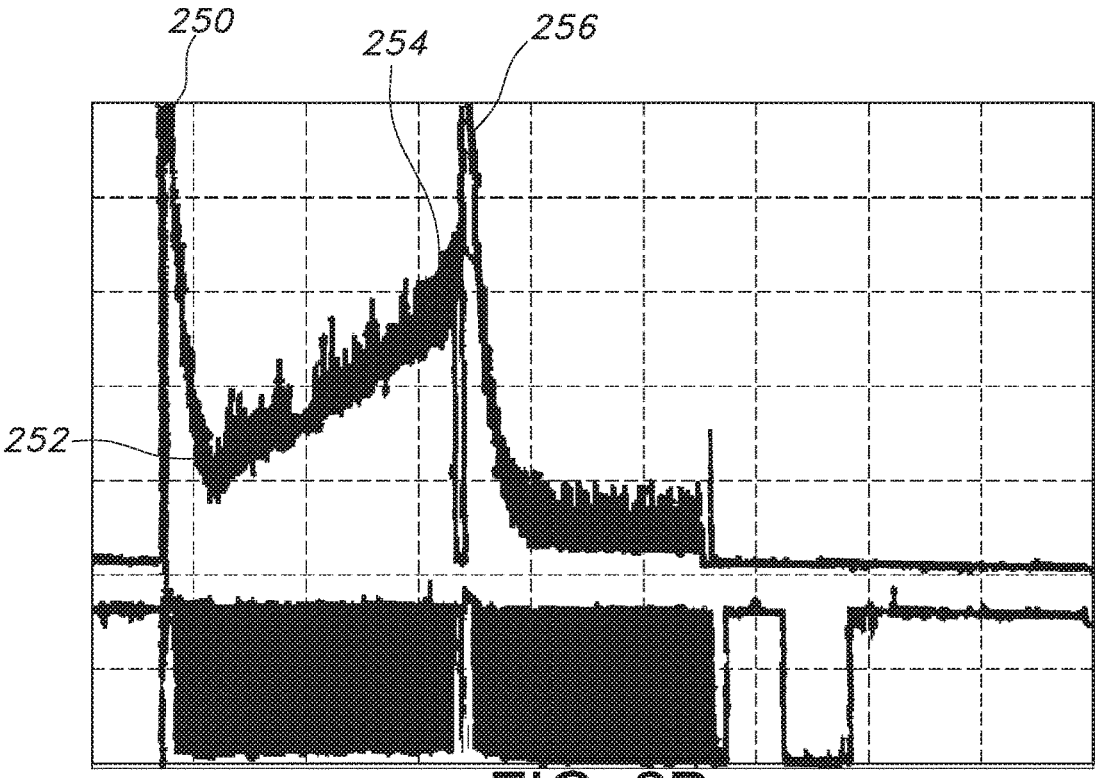
FIG. 2B is a representation of an example current demand profile over a dispense cycle.

Current demand of the motor during the initial dispense cycle is monitored (206). For example, the processing device 120 monitors the current demand during the dispense cycle. The current demand for the motor 111 changes over time during the various portions of the dispense cycle as the motor 111 works to move the piston 112 (and actuate the pump 106*a*). FIG. 2B is an example of a current demand profile over a dispense cycle, e.g., from home position 116 to dispense position 118 and back to home position 116.

In response to the processing device 120 instructing the motor module 110 to actuate, the motor turns on and draws an in-rush of current as shown at point 250. After the in-rush of current 250, the motor current drops to point 252, e.g., just before and/or at the point the motor 111 begins to move the piston 112 from its home position 116. As the motor 111 moves the piston 112 towards the dispensing position 118 the force of the spring (biasing the piston 112 towards the home position 116) increases, which causes the motor 111 to draw more current to overcome the increased spring force as the piston 112 nears the dispensing position 118. This is reflected as a gradual increase in current draw as shown between point 252 and point 254. As the piston 112 bottoms out (e.g., as the pump 106*a* is driven to the bottom its chamber or otherwise as the piston and/or pump 106*a* encounter a mechanical stop along the linear path of the piston stroke), the current spikes at point 256. The point at which the piston 112 bottoms out is at the dispensing position 118, which is also the point the current spike 256 occurs.

A spike in the current demand is determined (208). For example, the processing device 120, by monitoring the current demand/draw during the dispense cycle, determines the spike 256 in the current. As shown in FIG. 2B, after the piston 112 bottoms out and starts to return to the home position 116 from the dispensing position 118, the current draw starts to drop from point 256, in part, because the spring is now aiding the motor 111 move the piston 112 back to the home position 116.

In some implementations, the processing device 120 detects the significant rise, e.g., greater than fifteen percent (15%), in current from point 254 to point 256 over a predetermined period, e.g., administrator set to 0.05 to 0.25 seconds, and identifies point 256 as the spike. Additionally, or alternatively, the processing device 120 can compare the time rate of change of current after the in-rush current 250 has abated and identify the spike as the highest current demand during the period of the greatest increase in the time rate of change of current (e.g., from point 254 to point 256). In some implementations, the processing device 120 can determine the spike 256 based on the current exceeding a predefined current threshold, e.g., set by an administrator and corresponding to the piston 112 bottoming out.

A number of revolutions of the motor is determined between actuating the motor and determining the spike (210). For example, the processing device 120 determines the number of motor revolutions between motor actuation (e.g. at the home position 116) and the spike 256 (e.g., at the dispensing position 118). In some implementations, the processing device 120 starts the motor revolution counter in response to detecting the triggering signal or detecting the in rush of current 250 and stops the counter at the point the spike 256 is determined. In some scenarios the in rush current 250 is greater than the spike current 256.

The motor is reversed the number of revolutions to move the piston towards the home position (212). For example, the processing device 120 reverses the motor 111 the same number of revolutions as it determined/counted from the in rush current 250 to the spike 256 to move the piston 112 from the dispensing position 118 towards (e.g., back to) the home position 116.

Until another refill container 106 is installed or otherwise altered by an administrator or programmatically altered, the processing device 120 can move the piston 112 between the home position 116 and the dispensing position 118 by causing the motor 111 to turn the determined number of revolutions forward and in reverse. For example, the processing device 120, in response to the trigger signal, instructs the motor 111 to move the piston 112 from the home position 116 towards the dispensing position 118 and when the processing device 120 determines the motor 111 has rotated/revolved/turned the determined number of revolutions, e.g., through use of the Hall Effect sensor to count revolutions, the processing device 120 instructs the motor 111 to stop and reverse to move the piston 112 back towards the home position 116. In a similar manner, when the processing device 120 determines the motor has turned the determined number of revolutions in the reverse direction (to move the piston 112 back to the home positions 116) the processing device 120 instructs the motor 111 to stop, e.g., to prepare for the next dispense cycle.

In response to determining a new refill container 106 has been installed, the dispenser 100 can perform method 200 to determine the correct number of revolutions to drive the motor 111, as the refill may have a different pump/chamber 106*a* that requires a different number of motor revolutions to move the piston 112 and cause it to bottom out. The dispenser 100 then can use this new number of motor revolutions for the new refill container 106 for further dispenses. This auto calibration allows the dispenser 100 to accommodate various different containers 106 (e.g., with different metered dose dispensing amounts and pump 106*a* configurations) without requiring user intervention or adjustment.

In some implementations, the dispenser 100 will perform method 200 multiple times on the same container 106 to gain confidence in the determined number of motor revolutions through, for example, an averaging process, as there may be variables at play, e.g., humidity, temperature, machine tolerances, that result in slightly different numbers of determined revolutions across dispensing cycles for the same container 106. For example, the dispenser 100 (through programming set by an administrator) may perform method 200 a prescribed number of times each time a new container 106 is installed in the dispenser 100. Each of these determined numbers of revolutions can be averaged by the p[processing device 120 to calculate the final number of revolutions that the dispenser 100 will use going forward for dispenses for this container 106. Thus the dispenser 100, in response to detecting that a refill 106 has been inserted into the dispenser 100, repeats, for a plurality of dispense cycles, monitoring the current demand, determining a spike in the current demand, and determining a number of revolutions of the motor between actuating the motor and determining the spike and then determines an average number of revolutions based on the determined numbers of revolutions for each dispense cycle in the plurality of cycles.

In some implementations, the processing device 120, after determining the number of revolutions from method step 210, decreases the number of revolutions by a specific value to a reduced revolution count. And after the initial dispense cycle (or the multiple calibration cycles required for averaging as described above), drives the motor the reduced revolution count to move the piston 112 from the home position 116 towards the dispense position 118 and then moves the piston 112 the reduced revolution count back to the home position 116. Because the revolution count is reduced the piston 112 will not bottom out at the dispensing position 118 (because the piston 112 will not reach the dispensing position 118 which would require the motor moving the piston 112 the full revolution count, e.g., from method step 210). Avoiding this bottoming out reduces wear and tear on the dispenser 100 by not driving the motor 111 into a hard, mechanical stop, e.g., the bottom of the chamber. Table 1 shows various metrics from the operation of two different pumps 106*a*, Pump 1 and Pump 2, which are different sizes including requiring a different stroke length from the piston 112 to reach the respective dispensing positions 118.

More specifically, the stroke length describes the (linear) distance the piston 112 moves between the home position 116 and dispensing position 118, the Time Down describes the time it takes to move the piston 112 from the home position 116 to the dispensing position 118, the Time Up describes the time it takes to move the piston 112 from the dispensing position 118 to the home position 116, the In rush current describes the current draw of the motor at point 250, the Max current before bottom describes the current draw of the motor at point 254, the Current at bottom describes the current draw of the motor at point 256, the Current spike delta describes the increase in the current draw of the motor between points 254 and 256, Revolutions (calibration) describes the number of motor revolutions to move the piston 112 from the home position 116 to dispensing position 118 (e.g., from step 210), and Revolutions (operational) describes the reduced revolutions count.

TABLE 1

| Pump/ Container | Stroke length (mm) | Time Down (sec) | Time up (sec) | In-rush current (A) | Max current before bottom (A) | Current at bottom (A) | Current spike delta (%) | Revolutions (operational) | Revolutions (calibration) |
|---|---|---|---|---|---|---|---|---|---|
| 1 | 18.8 | 0.85 | 0.67 | 1.24 | 0.88 | 1.07 | 18 | 84 | 94 |
| 2 | 14.8 | 0.67 | 0.54 | 1.24 | 0.73 | 0.91 | 20 | 64 | 74 |

In the implementation described in Table 1, five motor revolutions move the piston 112 one millimeter (mm). Thus is takes 94 revolutions to move the piston 112 its full stroke of 18.8 mm for Pump 1 and 74 revolutions to move the piston 112 its full stroke of 18.8 mm for Pump 2. Thus the dispenser 100 can be designed to have a piston 112 with a maximum stroke length equal to the container 106 with the longest chamber compatible with the dispenser 100. Because of the auto-calibration process the piston 112 can be set to a stroke length to accommodate containers with shorter chambers and/or different pump 106*a* configurations.

Figure 2C:
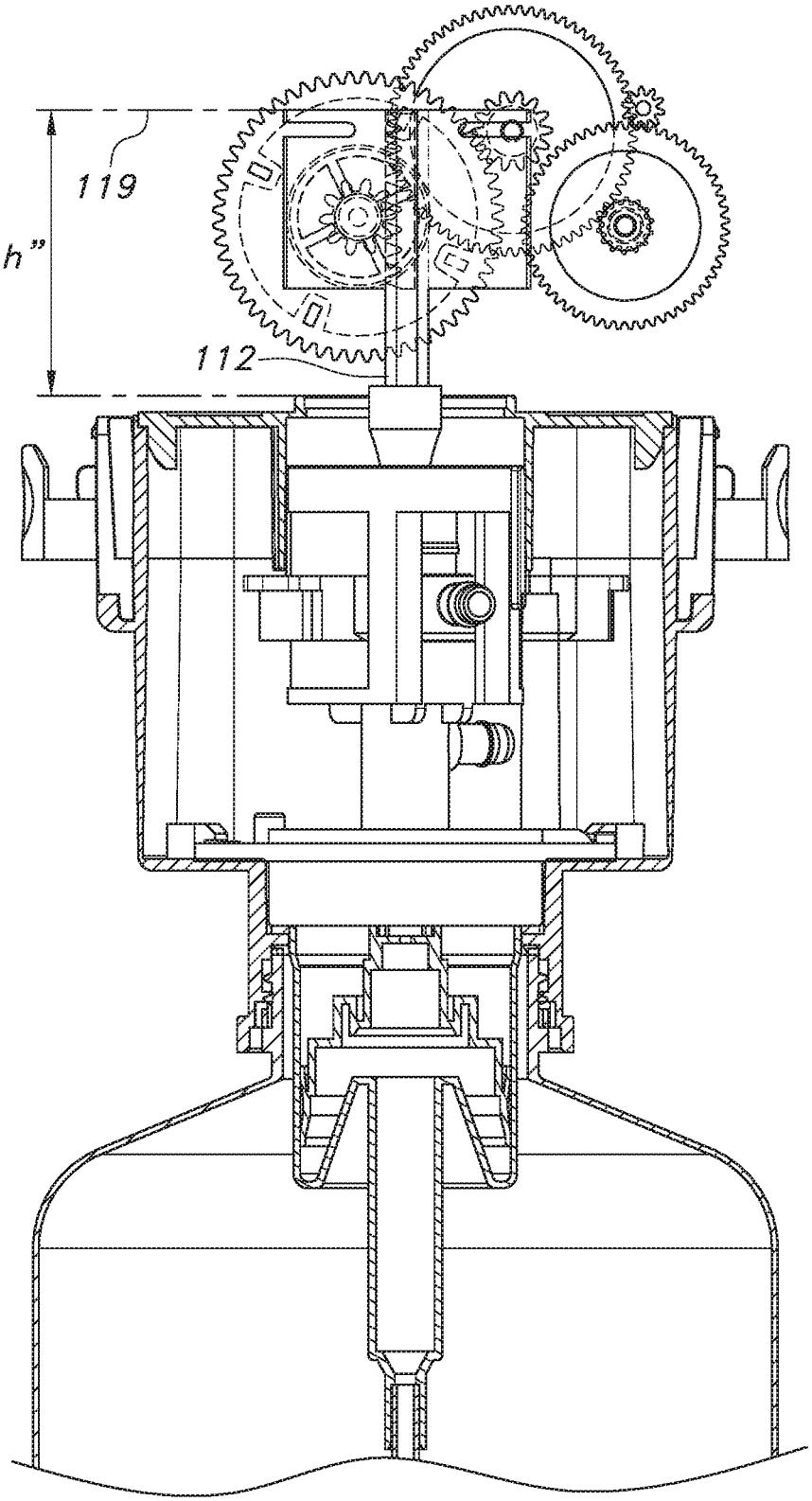
FIG. 2C is a partial cutaway representation of an example piston at the reduced revolution count position.

The processing device 120 can determine the reduced number of motor revolutions, for example, by lowering the stroke length by a predetermined amount, such as two (2) mm. Thus the reduced stroke length for Pumps 1 and 2 respectively is 16.8 and 12.8 mm, which converted to motor revolutions (the reduced number of motor revolutions) equals, respectively, 84 and 64. In some implementations, the processing device 120 determines the reduced number of motor revolutions by reducing the determined number of revolutions (e.g., from step 210) by a specified percentage such as, for example, five or ten percent. For example, FIG. 2 is a partial cutaway representation of the piston 112 at the reduced revolution count position 119 (at a height "h"' which is less that height "h" but greater than height "h"). More specifically, FIG. 2C shows the piston 112 at a stroke length of 12.8 mm down from the home position 116, as caused by the motor revolving 64 times to move the piston 112 down this distance.

In some implementations, monitoring the current demand includes the processing device 120 comparing the current demand during the initial dispense cycle (or any dispensing cycle) to one or more known current dispensing profiles, e.g., stored in the memory of the processing device 120, to determine if the current demand matches at least one known current dispensing profiles. Each known dispensing profiles corresponds (e.g., uniquely) to a different container 106. For example, FIG. 2B shows an example current demand profile for a dispensing cycle with a given container 106 (e.g., Model Z from Manufacturer X). Based on the type and configuration of container 106 the current profile for a dispensing cycle will vary across different containers. Thus the current demand profile is a signature for the type of container (e.g., model and/or manufacturer), and can be used determine whether an authorized container (e.g., a container 106 approved by the dispenser manufacturer or otherwise verified as being acceptable to use in the dispenser 100) is being used and/or the type or origin of the container 106 (e.g., model X or Y from manufacturer W or Z).

Using an unauthorized container 106 can result in sub-optimal performance or dispenser malfunctions. In some implementations, the processing device 120 can compare current demand profiles by comparing current levels at given times during the dispense cycle(s) to determine whether the current/timeline comparisons match or are within a given tolerance range of each other. For example, the processing device 120 can compare the in rush current 250 amplitude and spike current 256 amplitude and their respective timings during the dispensing cycle with those from the known current demand profiles to determine, for example, if the current demand for the in-process dispensing cycle matches a known profile and is thus authorized or not authorized, based on preprogrammed instructions designating particular current demand profiles as authorized or unauthorized. Thus if the processing device 120 determines that the under evaluation dispensing cycle matches a profile that has been designated as unauthorized then the processing device 120 can determine that the container is an unauthorized container.

In some implementations, in response to determining the current demand does not match at least one known current dispensing profile (and thus is not an authorized container 106), the processing device 120 can prevent further dispensing, communicate an alert indicating that an unauthorized refill/container 106 has been detected, cause the dispenser 106 to reduce an amount of liquid normally dispensed, cause the motor to move the piston 112 at a reduced speed, or some combination thereof. In some implementations, the known profiles can include profiles for unauthorized containers, and the dispenser 100 can take the remedial measures described above, in response to matching to one of these unauthorized profiles.

Aspects of the subject matter and the operations described in this specification can be implemented in digital electronic circuitry, or in computer software, firmware, or hardware, including the structures disclosed in this specification and their structural equivalents, or in combinations of one or more of them. Aspects of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

A computer storage medium (or memory or memory device) can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus or system on data stored on one or more computer-readable storage devices or received from other sources.

The term processing device 120 encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, firmware, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

Aspects of the processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

Aspects of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a user computer (e.g., for purposes of displaying data to and receiving user input from a user interacting with the user computer). Data generated at the user computer (e.g., a result of the user interaction) can be received from the user computer at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

This written description does not limit the invention to the precise terms set forth. Thus, while the invention has been described in detail with reference to the examples set forth above, those of ordinary skill in the art may effect alterations, modifications and variations to the examples without departing from the scope of the invention.

What is claimed is:

1. A control method for an electronic liquid dispenser, comprising:

receiving a dispense request for a liquid;

actuating a motor to move a piston from a home position to a dispense position during an initial dispense cycle to dispense the liquid;

monitoring a current demand of the motor during the initial dispense cycle;

determining a spike in the current demand;

determining a number of revolutions of the motor between actuating the motor and determining the spike; and reversing the motor the number of revolutions to move the piston towards the home position.

2. The method of claim 1, comprising:

decreasing the number of revolutions by a specific value to a reduced revolution count; and after the initial dispense cycle, driving the motor the reduced revolution count to move the piston from the home position towards the dispense position.

3. The method of claim 1, comprising detecting a refill has been inserted into the dispenser and, in response to the detecting:

monitoring the current demand;

determining the spike in the current demand;

determining the number of revolutions of the motor between actuating the motor and determining the spike.

4. The method of claim 3, comprising:

in response to the detecting, repeating, for each of a plurality of dispense cycles, monitoring the current demand, determining a spike in the current demand, and determining a number of revolutions of the motor between actuating the motor and determining the spike; and determining an average number of revolutions of the motor based on the determined numbers of revolutions for each dispense cycle.

5. The method of claim 1, wherein monitoring the current demand comprises detecting an in rush current, wherein the in rush current indicates the motor has been actuated.

6. The method of claim 5, wherein the in rush current is greater than the spike.

7. The method of claim 1, wherein the spike indicates the piston is at an end of its stroke at the dispense position.

8. The method of claim 1, wherein moving the piston from the home position to the dispense position takes longer than moving the piston from the dispense position back to the home position.

9. The method of claim 1, wherein determining a number of revolutions of the motor comprises using a Hall Effect sensor to count the number of revolutions.

10. The method of claim 1, comprising moving the piston from the home position to the dispense position and back through a rack and pinion system coupled to the motor.

11. The method of claim 1, wherein monitoring the current demand comprises comparing the current demand during the initial dispense cycle to one or more known current dispensing profiles to determine if the current demand matches at least one of the one or more known current dispensing profiles.

12. The method of claim 11, comprising in response to determining the current demand does not match at least one of the one or more known current dispensing profiles, preventing further dispensing.

13. The method of claim 11, comprising in response to determining the current demand does not match at least one of the one or more known current dispensing profiles, communicating an alert indicating that an unauthorized refill has been detected.

14. The method of claim 11, comprising in response to determining the current demand does not match at least one of the one or more known current dispensing profiles, causing the dispenser to reduce an amount of liquid normally dispensed.

15. The method of claim 11, comprising in response to determining the current demand does not match at least one of the one or more known current dispensing profiles, causing the motor to move the piston at a reduced speed.

16. An electronic liquid dispenser comprising:

a dispensing head comprising a dispensing sensor configured to issue a dispensing trigger in response to a user stimulus proximate the dispensing head;

a motor module comprising a piston, wherein the motor module is configured to move the piston from a home position to a dispensing position in response to the dispensing trigger;

a liquid container configured to hold liquid, and comprising a pump operatively connected to the piston and configured to drive the liquid from the liquid container in response to the piston moving from the home position to the dispensing position; and a processing device coupled to the motor module and configured to control an operation of the motor module and determine a number of motor revolutions required to move the piston from the home position to the dispensing position based on a current spike to the motor module indicating that the piston has reached the dispensing position.

17. The electronic liquid dispenser of claim 16, wherein the processing device is configured to reduce the number of motor revolutions by a predetermined amount to a reduced motor revolution count and thereafter cause the motor to turn the reduced motor revolution count to move the piston from the home position towards the dispensing position.

* * * * *